US006976582B2

(12) United States Patent
Chen

(10) Patent No.: US 6,976,582 B2
(45) Date of Patent: Dec. 20, 2005

(54) TOOL-HOLDING APPARATUS

(76) Inventor: Terence Chen, No. 325, Yung Ching Road, Tung Shan Hsiang, Lo Tung Town, Yi Lan Hsien (TW)

( * ) Notice: Subject to any disclaimer, the term of this patent is extended or adjusted under 35 U.S.C. 154(b) by 0 days.

(21) Appl. No.: 10/691,304

(22) Filed: Oct. 22, 2003

(65) Prior Publication Data

US 2005/0051446 A1 Mar. 10, 2005

(30) Foreign Application Priority Data

Sep. 10, 2003 (TW) ..... 92124963 A

(51) Int. Cl.[7] ..... B65D 85/28; A47F 7/00

(52) U.S. Cl. ..... 206/376; 206/480; 206/482; 211/70.6

(58) Field of Search ..... 206/376, 477–478, 206/480–482; 211/70.6

(56) References Cited

U.S. PATENT DOCUMENTS

| | | | | |
|---|---|---|---|---|
| 5,535,881 | A * | 7/1996 | Krivec | 206/376 |
| 5,598,924 | A * | 2/1997 | McCann | 211/70.6 |
| 5,638,964 | A * | 6/1997 | Ernst | 211/70.6 |
| 6,315,121 | B1 * | 11/2001 | Hansen | 206/376 |
| 6,401,923 | B1 * | 6/2002 | Huang | 206/376 |
| 2002/0121491 | A1 * | 9/2002 | Ernst | 211/70.6 |

* cited by examiner

*Primary Examiner*—Bryon P. Gehman
(74) *Attorney, Agent, or Firm*—Alan D. Kamrath; Nikolai & Mersereau, P.A.

(57) ABSTRACT

A tool-holding apparatus is provided for holding at least one tool. The tool-holding apparatus includes a board and at least one holder formed on the board. The holder includes a root extending from the board, a tip extending from the root for pressing the tool, a restraint formed thereon near the tip for restraining the tool and a concave portion defined therein near the root for receiving the tool.

15 Claims, 6 Drawing Sheets

TOOL-HOLDING APPARATUS

FIELD OF INVENTION

The present invention relates to a tool-holding apparatus.

BACKGROUND OF INVENTION

Referring to FIG. 5, a conventional tool-holding apparatus 60 includes a board 62 and two rows of holders 64 formed on the board 62. Referring to FIG. 6, each holder 64 is formed on a plain area 63 of the board 62. A concave area 65 is located next to each plain area 63. Each holder 64 includes a first section 66 extending from each plain area 63, a second section 68 extending from the first section 66, a third section 70 extending from the second section 68 and a stop 72 extending from the first section 66 opposite to the second section 68. A gap 74 exists between the third section 70 of each holder 64 and each plain area 63 of the board 62. A gap 76 exists between the first section 66 of each holder 64 and the third section 70 of the next holder 64. A spanner 100 is put in the gap 76 so that the spanner 100 presses the third section 70 towards the plain area 63. Hence, the spanner 100 is restrained by the stop 72 and the third section 70. However, the gap 76 is too narrow to encompass various sizes of spanners. Moreover, the gap 74 is too narrow to allow adequate pivotal movement of the third section 70 caused by insertion of the spanner 100. That is, the third section 70 is squeezed between the plain area 63 and the spanner 100. Thus, the third section 70 is deformed and might therefore be damaged. When subject to vibration, the spanner 100 can easily slide on and past the stop 72 and fail from the tool-holding apparatus 60.

The present invention is therefore intended to obviate or at least alleviate the problems encountered in the prior art.

SUMMARY OF INVENTION

The primary objective of the present invention is to provide a tool-holding apparatus to which a spanner can be securely held and from which the spanner can easily be taken.

According to the present invention, a tool-holding apparatus is provided for holding at least one tool. The tool-holding apparatus includes a board and at least one holder formed on the board. The holder includes a root extending from the board, a tip extending from the root for pressing the tool, a restraint formed thereon near the tip for restraining the tool and a concave portion defined therein near the root for receiving the tool.

Other objectives, advantages, and novel features of the invention will become more apparent from the following detailed description when taken in conjunction with the attached drawings.

BRIEF DESCRIPTION OF DRAWINGS

The present invention will be described through detailed illustration of the preferred embodiment referring to the attached drawings.

DETAILED DESCRIPTION OF PREFERRED EMBODIMENT

Figure 1:
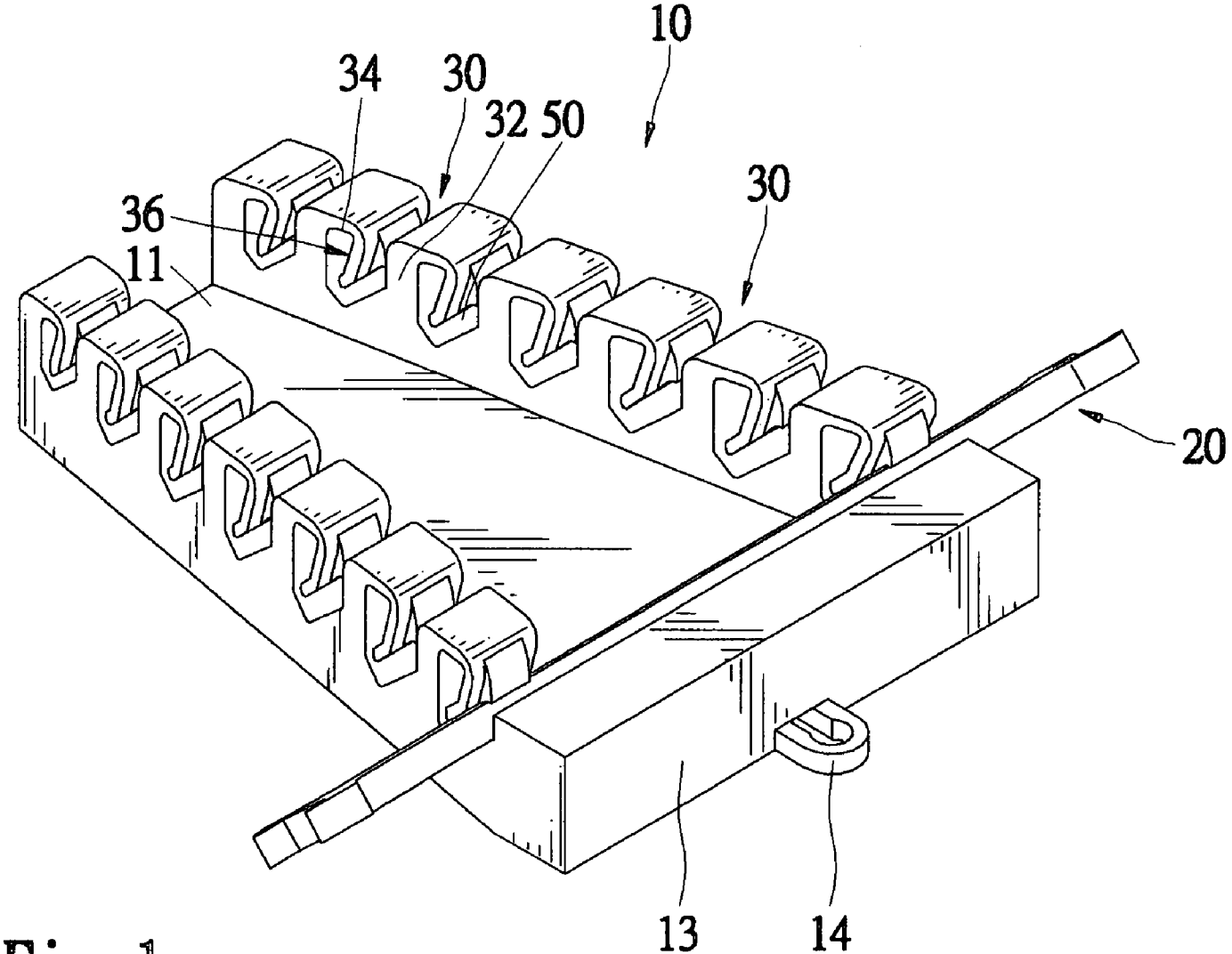
FIG. 1 is a perspective view of a spanner held by a tool-holding apparatus according to the preferred embodiment of the present invention.
Figure 2:
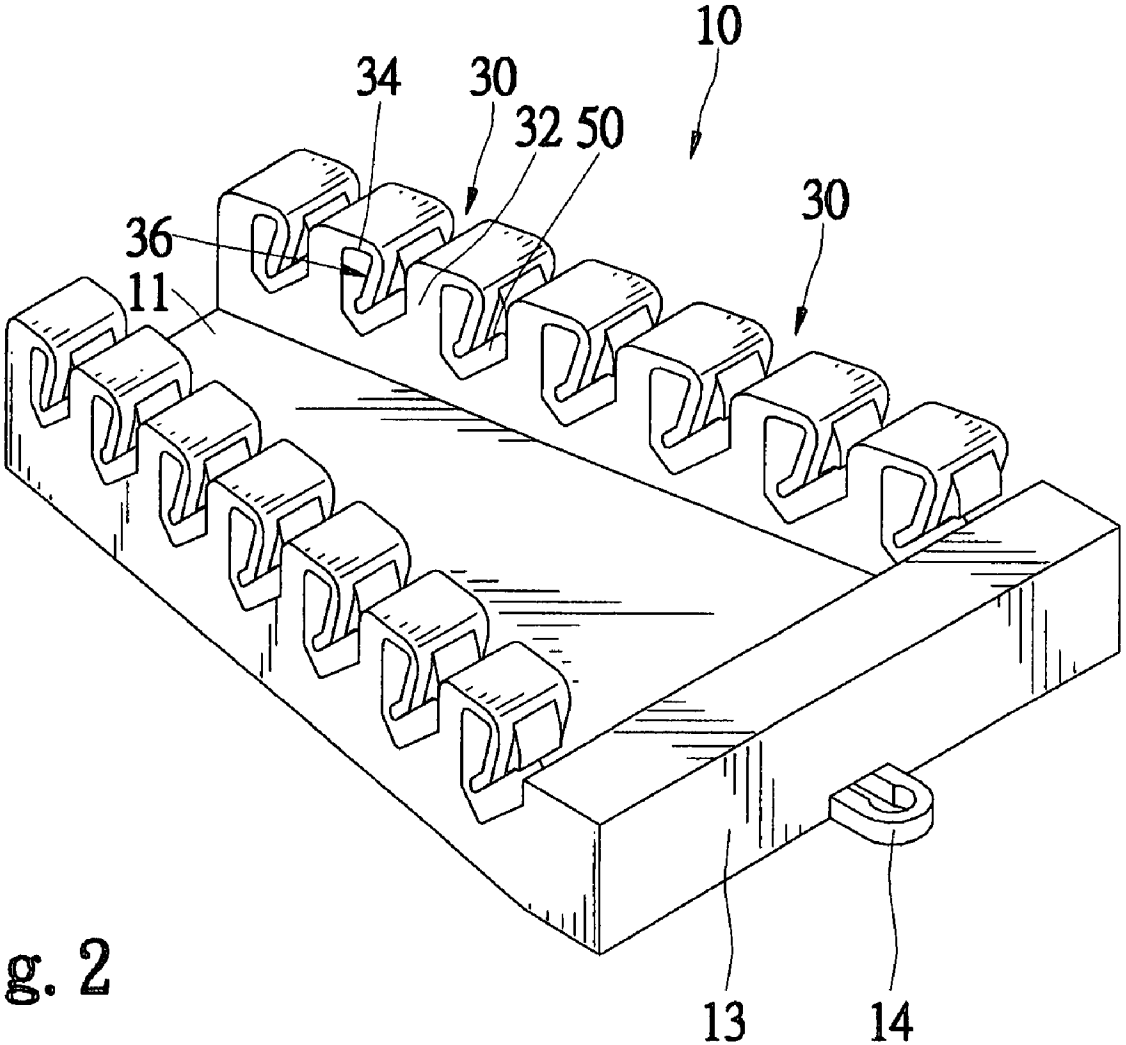
FIG. 2 is a perspective view of the tool-holding apparatus of FIG. 1.

Referring to FIGS. 1 and 2, according to the preferred embodiment of the present invention, a tool-holding apparatus 10 includes a board 11, a ridge 13 formed on the board 11 and two rows of holders 30 formed on the board 11. An ear 14 extends from the ridge 13. The ear 14 is used for hanging the tool-holding apparatus 10 on the wall.

Figure 3:
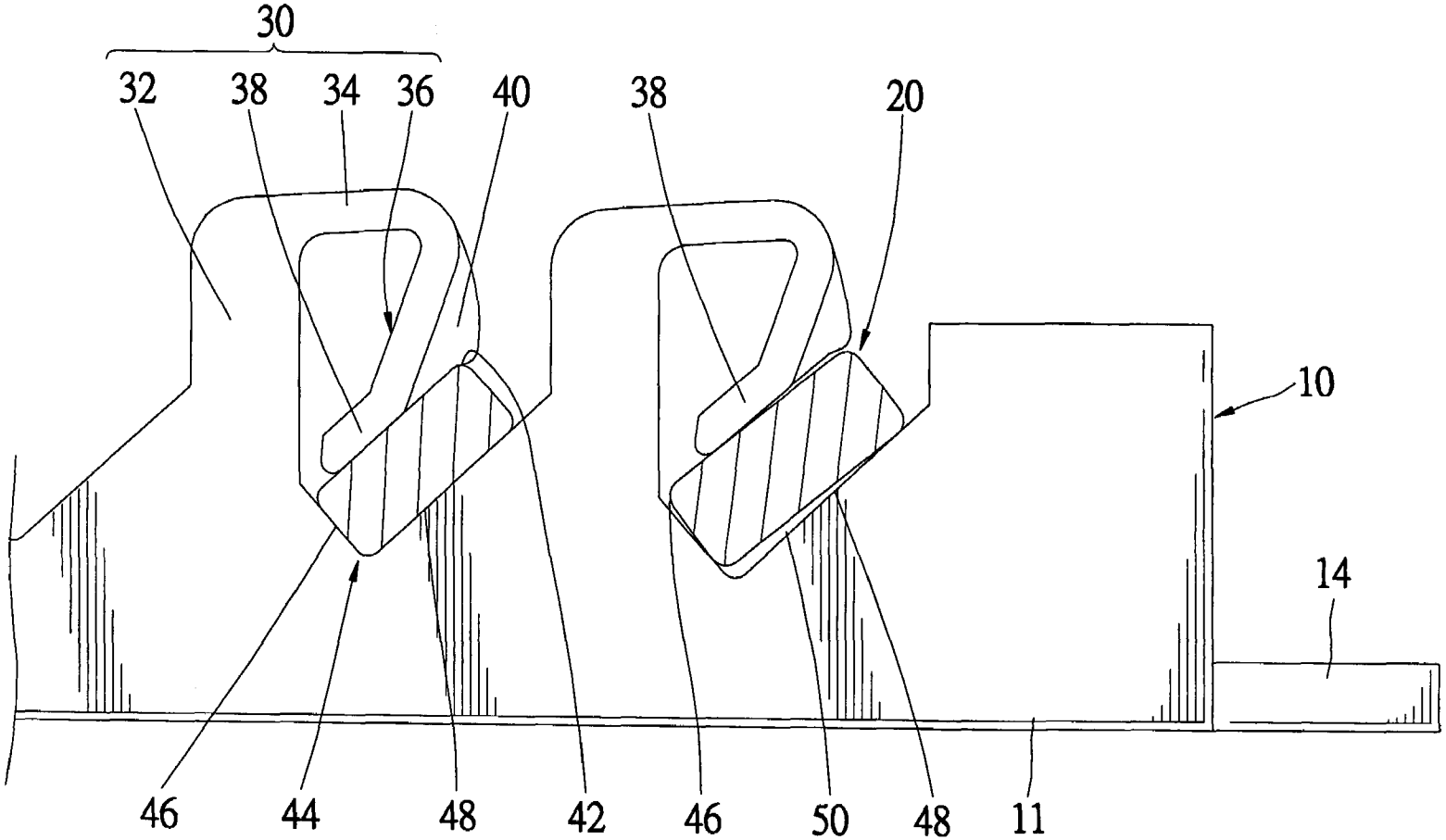
FIG. 3 is a partial side view of the tool-holding apparatus of FIG. 1 holding two spanners.

Referring to FIG. 3, each holder 30 is shaped like a curve. In specific, each holder 30 includes a first section 32 extending perpendicularly from the board 11, a second section 34 extending substantially perpendicularly from the first section 32, a third section 36 extending obliquely from the second section 34, a fourth section 38 extending obliquely from the third section 36 and a restraint 40 formed on the third section 36. An obtuse protrusion 42 extends from the restraint 40 of each holder 30. A concave area 44 is located next to the first section 32 of each holder 30. The concave area 44 includes a first facet 46 and a second facet 48. Between the fourth section 38 and the second facet 48 exists a gap 50 for receiving a spanner 20. The spanner 20 is pressed against the second facet 48 by the fourth section 38 and the restraint 40 and hooked by the obtuse protrusion 42 of the restraint 40.

The first section 32 can be referred to as the "root." The fourth section 38 can be referred to as the "tip." Each holder 30 can include a smoothly curved configuration that is not divided into four sections, yet it must include a flexible tip for pressing the spanner 20 and a stop for hooking the spanner 20.

Figure 4:
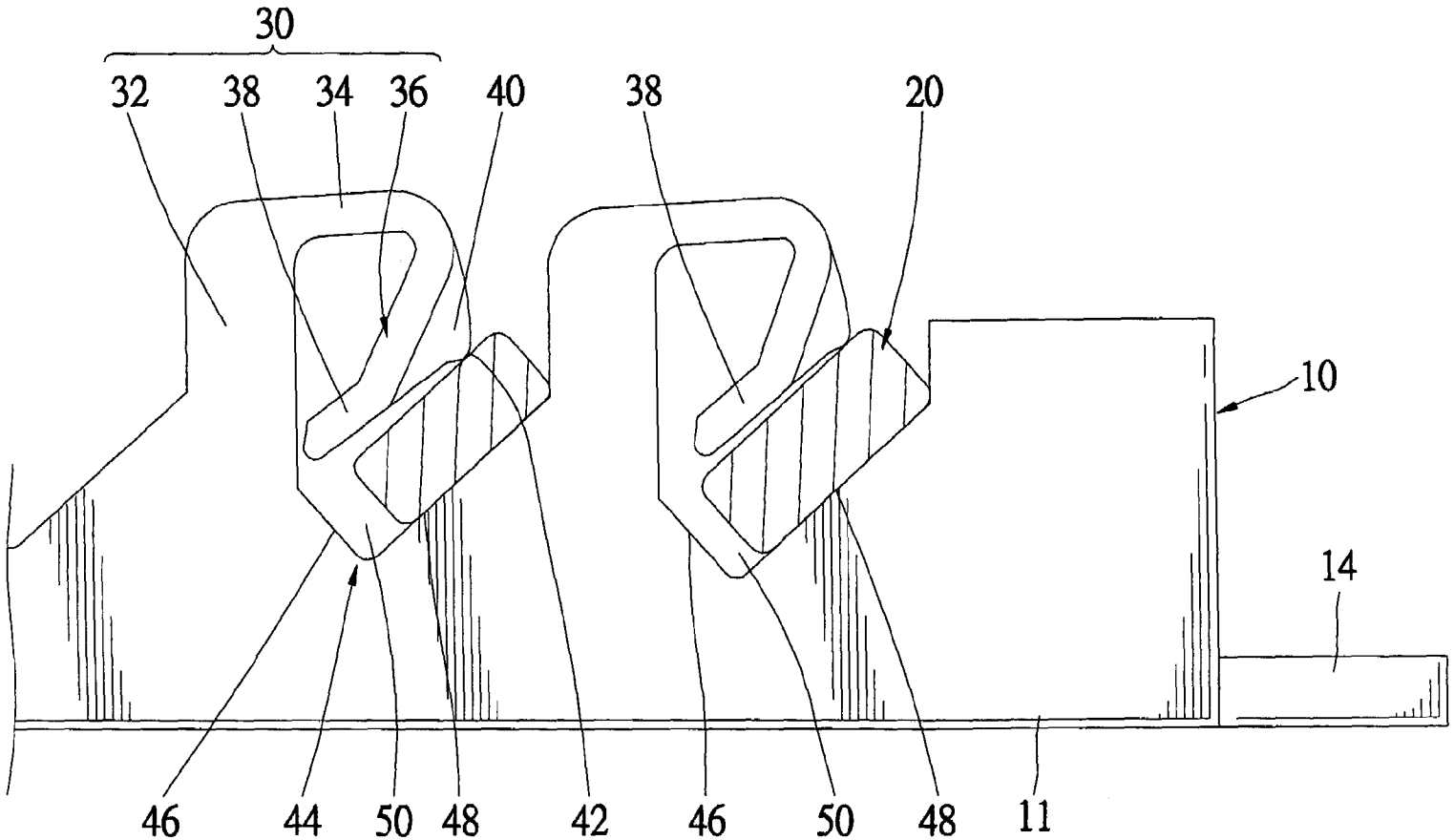
FIG. 4 is similar to FIG. 3 but shows the spanner in another position.
Figure 5:
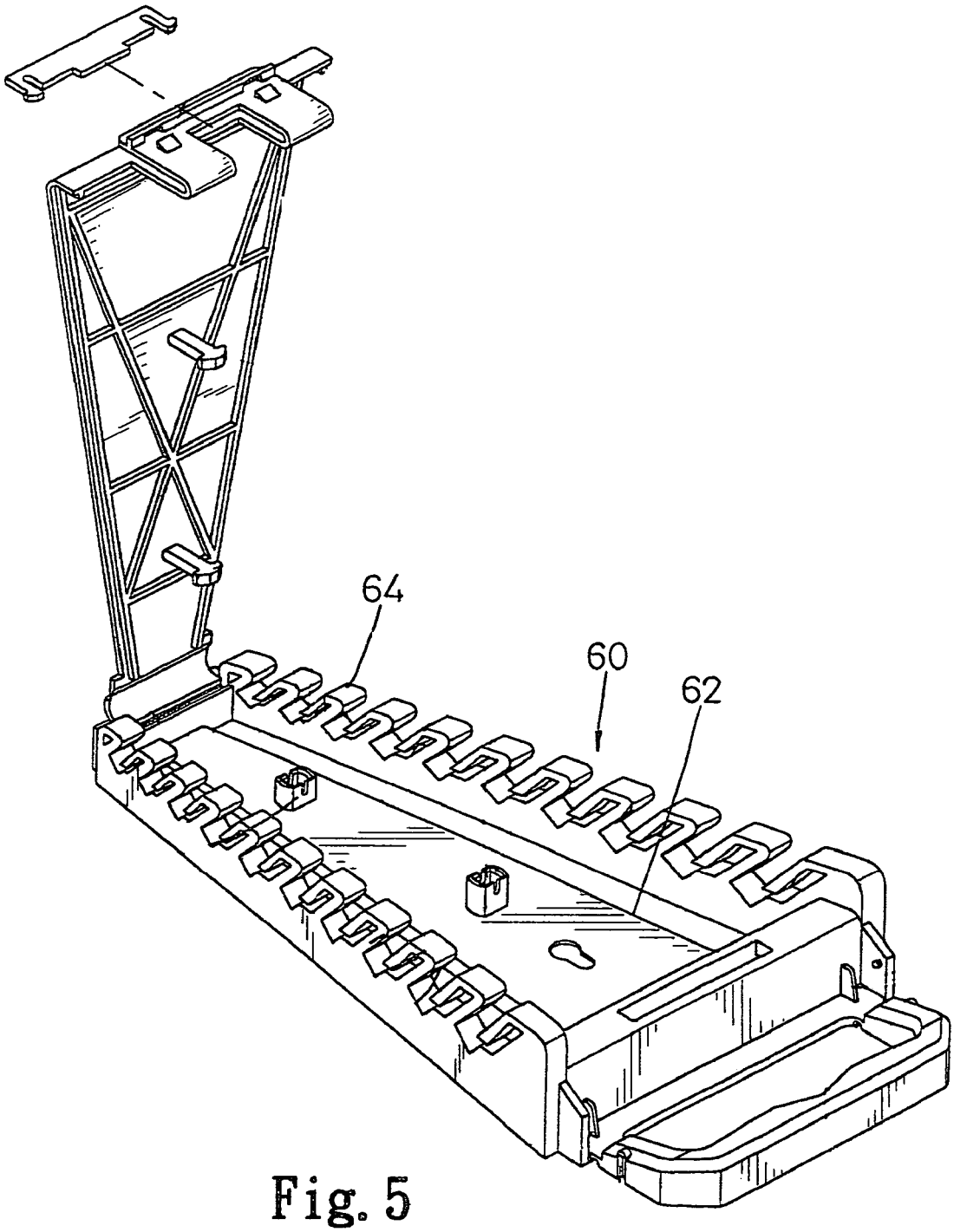
Fig. 5 PRIOR ART
FIG. 5 is a perspective view of a conventional tool-holding apparatus.
Figure 6:
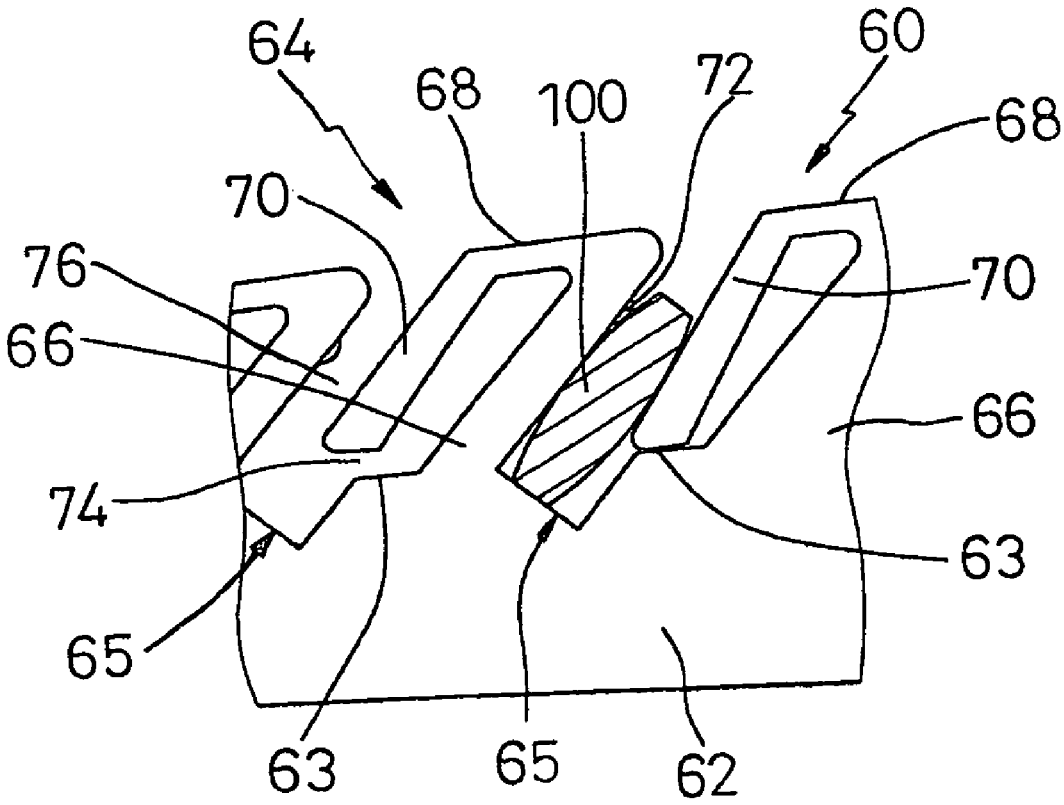
Fig. 6 PRIOR ART
FIG. 6 is a partial side view of the tool-holding apparatus of FIG. 5.

Referring to FIG. 4, when the tool-holding apparatus 10 is vibrated, the spanner 20 tends to slide upwardly towards the first section 32 of the next holder 30. The spanner 20 however cannot substantially slide since it is pressed against the facet 48 by the fourth section 38 and the restraint 40 and hooked by the obtuse protrusion 42 of the restraint 40.

The present invention has been described through detailed illustration of the preferred embodiment. Those skilled in the art can derive variation from the preferred embodiment without departing from the scope of the present invention. Therefore, the preferred embodiment shall not limit the scope of the present invention defined in the claims.

What is claimed is:

1. A tool-holding apparatus for holding at least one tool, the tool-holding apparatus comprising:

a board;

at least one holder formed on the board, the at least one holder comprising a root extending perpendicularly from the board, wherein the at least one holder includes a substantially horizontal section extending perpendicularly from the root parallel to the board, wherein the at least one holder includes an inclined section extending obliquely from the substantially horizontal section toward the board, wherein the at least one holder includes a tip extending obliquely at an interconnection from the inclined section for pressing the at least one tool, and a restraint formed on the inclined section and extending from the interconnection away from the tip for restraining the at least one tool, with the root, substantially horizontal section, tip and restraint being formed as a single, integral piece and shaped like a curve, with a side of the restraint and the tip opposite to the substantially horizontal section defining a planar abutment surface; and a concave portion defined in the board near the root for receiving the at least one tool, wherein the tip is separated from the concave portion by a gap for receiving the at least one tool abutting with the planar abutment surface.

2. The tool-holding apparatus according to claim 1 including at least one pair of holders for holding a tool, with the concave portion being defined between the at least one pair of holders.

3. The tool-holding apparatus according to claim 2 including a plurality of holders.

4. The tool-holding apparatus according to claim 3 wherein the restraint includes an obtuse protrusion formed on the planar abutment surface defined by the restraint spaced from the tip.

5. The tool-holding apparatus according to claim 3 wherein the concave area includes a first facet and a second facet extending from the first facet.

6. The tool-holding apparatus according to claim 5 wherein the planar abutment surface is generally parallel to but spaced from the second facet, with the second facet extending perpendicularly from the first facet, with the first facet extending obliquely from the root.

7. The tool-holding apparatus according to claim 2 wherein the concave area includes a first facet and a second facet extending from the first facet.

8. The tool-holding apparatus according to claim 7 wherein the planar abutment surface is generally parallel to but spaced from the second facet, with the second facet extending perpendicularly from the first facet, with the first facet extending obliquely from the root.

9. The tool-holding apparatus according to claim 1 wherein the restraint includes an obtuse protrusion formed on the planar abutment surface defined by the restraint spaced from the tip.

10. The tool-holding apparatus according to claim 9 wherein the concave portion includes a first facet and a second facet extending from the first facet.

11. The tool-holding apparatus according to claim 10 wherein the planar abutment surface is generally parallel to but spaced from the second facet, with the second facet extending perpendicularly from the first facet, with the first facet extending obliquely from the root.

12. The tool-holding apparatus according to claim 8 including an ear extending from the board for hanging the tool-holding apparatus on the wall.

13. The tool-holding apparatus according to claim 12 wherein the restraint includes an obtuse protrusion formed on the planar abutment surface defined by the restraint spaced from the tip.

14. The tool-holding apparatus according to claim 1 wherein the concave portion includes a first facet and a second facet extending from the first facet.

15. The tool-holding apparatus according to claim 14 wherein the planar abutment surface is generally parallel to but spaced from the second facet, with the second facet extending perpendicularly from the first facet, with the first facet extending obliquely from the root.

* * * * *